US007720229B2

(12) United States Patent
Duraiswami et al.

(10) Patent No.: US 7,720,229 B2
(45) Date of Patent: May 18, 2010

(54) METHOD FOR MEASUREMENT OF HEAD RELATED TRANSFER FUNCTIONS

(75) Inventors: Ramani Duraiswami, Columbia, MD (US); Nail A. Gumerov, Elkridge, MD (US)

(73) Assignee: University of Maryland, College Park, MD (US)

( * ) Notice: Subject to any disclaimer, the term of this patent is extended or adjusted under 35 U.S.C. 154(b) by 1675 days.

(21) Appl. No.: 10/702,465

(22) Filed: Nov. 7, 2003

(65) Prior Publication Data

US 2004/0091119 A1 May 13, 2004

Related U.S. Application Data

(60) Provisional application No. 60/424,827, filed on Nov. 8, 2002.

(51) Int. Cl.
*H04R 5/00* (2006.01)
*H04R 5/02* (2006.01)

(52) U.S. Cl. ..... 381/17; 381/18; 381/19; 381/26; 381/307; 381/309

(58) Field of Classification Search ..... 381/309, 381/17–19, 303, 307, 26
See application file for complete search history.

(56) References Cited

U.S. PATENT DOCUMENTS

| | | | | | |
|---|---|---|---|---|---|
| 5,173,944 | A * | 12/1992 | Begault | ..... | 381/17 |
| 5,982,903 | A * | 11/1999 | Kinoshita et al. | ..... | 381/18 |
| 6,167,138 | A * | 12/2000 | Shennib | ..... | 381/60 |
| 6,259,795 | B1 * | 7/2001 | McGrath | ..... | 381/310 |
| 2003/0138116 | A1 * | 7/2003 | Jones et al. | ..... | 381/94.1 |

* cited by examiner

*Primary Examiner*—Vivian Chin
*Assistant Examiner*—George C Monikang
(74) *Attorney, Agent, or Firm*—Rosenberg, Klein & Lee

(57) ABSTRACT

Head Related Transfer Functions (HRTFs) of an individual are measured in rapid fashion in an arrangement where a sound source is positioned in the individual's ear channel, while microphones are arranged in the microphone array enveloping the individual's head. The pressure waves generated by the sounds emanating from the sound source reach the microphones and are converted into corresponding electrical signals which are further processed in a processing system to extract HRTFs, which may then be used to synthesize a spatial audio scene. The acoustic field generated by the sounds from the sound source can be evaluated at any desired point inside or outside the microphone array.

14 Claims, 6 Drawing Sheets

METHOD FOR MEASUREMENT OF HEAD RELATED TRANSFER FUNCTIONS

REFERENCE TO RELATED APPLICATIONS

This Utility Patent Application is based on Provisional Patent Application Ser. No. 60/424,827 filed on 8 Nov. 2002.

FIELD OF THE INVENTION

The present invention relates to measurement of Head Related Transfer Functions (HRTFs), and particularly, to a method for a rapid HRTF acquisition enhanced with an interpolation procedure which avoids audible discontinuies in sound. The method further permits the obtaining the range dependence of the HRTFs from the measurements conducted at a single range.

Further, the present invention relates to measurements of HRTFs based on a measurement arrangement in which a source of a sound is placed in the ear canal of an individual and an acquisition microphone array is positioned in enveloping relationship with the individual's head to acquire pressure waves generated by the sound emanating from the sound source in the ear by a plurality of microphones in the array thereof. The acquired pressure waves are then processed to extract the HRTF.

Still further, the present invention relates to HRTF calculations and representations in a form appropriate for storage in a memory device for further use of the measured HRTFs of an individual to simulate synthetic audio spatial scenes.

BACKGROUND OF THE INVENTION

Humans have the ability to locate a sound source with better than 5° accuracy in both azimuth and elevation. Humans also have the ability to perceive and approximate the distance of a source from them. In this regard, multiple cues may be used, including some that arise from sound scattering from the listener themselves (W. M. Hartmann, "How We Localize Sound", Physics Today, November 1999, pp. 24-29).

The cues that arise due to scattering from the anatomy of the listener exhibit considerable person-to-person variability. These cues may be encapsulated in a transfer function that is termed the Head Realted Transfer Function (HRTF).

In order to recreate the sound pressure at the eardrums to make a synthetic audio scene indistinguishable from the real one, the virtual audio scene must include the HRTF-based cues to achieve accurate simulation (D. N. Zotkin, et al., "Creation of Virtual Auditory Spaces", 2003, accepted IEEE Trans. Multimedia—available off authors' homepages).

The HRTF depends on the direction of arrival of the sound, and, for nearby sources, on the source distance. If the sound source is located at spherical coordinates (r, θ, ϕ), then the left and right HRTFs $H_l$ and $H_r$ are defined as the ratio of the complex sound pressure at the corresponding eardrum $\psi_{l,r}$ to the free-field sound pressure at the center of the head $\psi_f$ as if the listener is absent (R. O. Duda, et al., "Range Dependence of the Response of a Spherical Head Model", J. Acoust. Soc. Am., 104, 1998, pp. 3048-3058).

$$H_{l,r}(\omega, r, \theta, \varphi) = \frac{\psi_{l,r}(\omega, r, \theta, \varphi)}{\psi_f(\omega)} \tag{1}$$

To synthesize the audio scene given the source location (r,ϕ,θ) one needs to filter the signal with H(r,ϕ,θ) and the result rendered binaurally through headphones. To obtain the HRTFs for a given individual, an arrangement such as depicted in FIG. 1 is used. A source (speaker) is placed at a given location (r,θ,ϕ), and a generated sound is then recorded using a microphone placed in the ear canal of an individual. In order to obtain the HRTF corresponding to a different source location, the speaker is moved to that location and the measurement is repeated. The listener is required to remain stationary during this process in order that the location for the HRTF may be reliably described. HRTF measurements from thousands of points are needed, and the process is time-consuming, tedious and burdensome to the listener. One of the reasons spatial audio technology has been hampered is the unavailability of rapid HRTF measurement techniques.

Additionally, HRTF must be interpolated between discrete measurement positions to avoid audible jumps in sound. Many techniques have been proposed to perform the interpolation of the HRTF, however, proper interpolation is still regarded as an open question.

In addition, the dependence of the HRTF on the range r (distance between the source of the sound and the microphone) is also usually neglected since the HRTF measurements are tedious and time-consuming procedures. However, since the HRTF measured at a distance is known to be incorrect for relatively nearby sources, only relatively distant sources are simulated.

As a result of these inadequacies, HRTF measurement methods suffer from a lack of a complete range of measurements for the HRTF. However, many applications such as games, auditory user interfaces, entertainment, and virtual reality simulations demand the ability to accurately simulate sounds at relatively close ranges.

The Head Related Transfer Function characterizes the scattering properties of a person's anatomy (especially the pinnae, head and torso), and exhibits considerable person-to-person variability. Since the HRTF arises from a scattering process, it can be characterized as a solution of a scattering problem.

When a body with surface S scatters sound from a source located at $(r_1, \theta_1, \phi_1)$ the complex pressure amplitude ψ at any point (r,θ,ϕ) is known to satisfy the Helmholtz equation in a source free domain $$\nabla^2\psi(x, k)+k^2\psi(x, k)=0. \tag{2}$$

Outside a surface S that contains all acoustic sources in the scene, the potential ψ(x,k) is regular and satisfies the Sommerfeld radiation condition at infinity:

$$\lim_{r\to\infty} r\left(\frac{\partial\psi}{\partial r} - ik\psi\right) = 0 \tag{3}$$

Outside S, the regular potential ψ(x,k) that satisfies equation (2) and condition (3) may be expanded in terms of singular elementary solutions (called multipoles). A multipole $\Phi_{lm}(x,k)$ is characterized by two indices m and l which are called order and degree, respectively. In spherical coordinates, x=(r,θ,ϕ)

$$\Phi_{lm}(r;\theta,\phi,k)=h_l(kr)Y_{lm}(\theta,\phi), \tag{4}$$

Where $h_l$ (kr) are the spherical Hankel functions of the first kind, and $Y_{lm}(\theta,\phi)$ are the spherical harmonics, $$Y_{lm}(\theta, \varphi) = (-1)^m \sqrt{\frac{(2n+1)(l-|m|!)}{4\pi(l+|m|!)}} P_l^{|m|}(\cos\theta) e^{im\varphi} \quad (5)$$

where $P_n^{|m|}(\lambda)$ are the associated Legendre functions.

In the arrangement, shown in FIG. 1, a representation of the potential in the region between the head and the many speaker locations is sought. Unfortunately this region contains sources (the speaker), and the scatterer, and thus does not satisfy the conditions for a fitting by multipoles (i.e., source free, and extending to infinity.

Therefore it would be highly desirable to provide a technique for rapid measurement of range dependent individualized HRTFs, correct interpolation procedures associated therewith, and procedures which permit development of HRTFs in terms of a series of multipole solutions of the Helmholtz equation.

SUMMARY OF THE INVENTION

It is an object of the present invention to provide a method for measuring of Head Related Transfer Functions (HRTFs) based on reciprocity principles. In this scenario, transmitter is placed in the ear (ears) of a listener, while receivers of the scattered and direct sounds in the form of an acquisition microphone array are positioned around the head of the listener.

It is another object of the present invention to provide a method for measurement of HRTFs in which a multiplicity of microphones are distributed around a listener's head, while a speaker is positioned in each ear canal. Pressure waves generated by a test sound emanating from the speaker are registered by the microphones at their locations. Head Related Transfer Functions are extracted from these measurements on the basis of the theory of acoustics where multiphase solutions of the Helmholtz equations are interpolated and extrapolated to any point in the space surrounding the listener's head thereby obtaining range dependent HRTFs.

It is a further object of the present invention to provide a correct interpolation technique of the measured HRTFs which permits evaluation of the acoustic field generated by a sound source positioned in the listener's ear. The evaluation may be attained at any desired point around the listener's head.

It is also an object of the present invention to provide a process of measurement of the Head Related Transfer Functions of an individual for the compact representation thereof as sums of multiple solutions, simplification of such a representation (convolution of the Head Related Transfer Functions), and storing the HRTFs on a memory device for synthesis of the audio scene for the individual based on his/her Head Related Transfer Functions.

The present invention further represents a method for measurement of Head Related Transfer Functions of an individual in which a source of a sound (microspeaker) is placed in the ear (or both ears) of an individual while a plurality of pressure wave sensors (microphones) in the form of acquisition microphone array "envelope" the individual's head.

The microspeaker emanates a predetermined combination of audio signals (e.g., pseudorandom binary signals or Golay codes or sweeps), and the pressure waves generated by the emanated sound are collected at the microphones surrounding the individual's head. These pressure waves approaching the microphones represent a function of the geometrical parameters of the individuals, such as shapes and dimensions of the individual's head, ears, neck, shoulders, and to a lesser extent the texture of the surfaces thereof. The collected audio signals are converted at the microphones into electric signals and are recorded in a data acquisition system for further processing to extract the Head Related Transfer Functions of the individual.

The Head Related Transfer Functions of the individual may be stored on a memory device which is adapted for interfacing with a headphone. In the headphone, the Head Related Transfer Functions of the individual are mixed with sounds to emanate from the headphone, and the combined sounds are played to the individual thus creating an audio reality for him/her.

The HRTFs are extracted from the measured wave pressures (in their electric representation) by transforming the time domain electric signals into the frequency domain, and by applying a HRTF fitting procedure thereto by transferring the same to spherical function coefficients domain.

In the fitting procedure, for each wavenumber in the frequency domain data, a truncation number "p" is selected, and an acoustic equation provided in the detailed description (7)

$$\Phi\alpha=\Psi \quad (5a)$$

is solved, wherein $\alpha$ are vectors of multipole decomposition coefficients, $\Phi$ is the matrix of multipoles evaluated at microphone locations, and $\Psi$ is obtained from a set of signals measured at microphone locations.

Further, the present invention is a system for measurement, analysis and extraction of Head Related Transfer Functions. The system is based on the reciprocity principle, which states that if the acoustic source at point A in arbitrary complex audio scene creates a potential at a point B, then the same acoustic source placed at point B will create the same potential at a point A.

The system of the present invention includes a sound source placed in an individual's ear (ears), an array of pressure waves sensors (microphones) positioned to envelope the individual's head, and means for generating a predetermined combination of audio signals (e.g., pseudorandom binary signals). These predetermined combination of audio signals are supplied to the source of a sound wherein the microphones collect pressure waves generated by the audio signal emanated from the source of a sound. The pressure waves are a function of the anatomic features of the individual. The microphones collect the pressure waves reaching them, convert these pressure waves into electrical signals, and supply them to a data acquisition system. A data acquisition system to which the electric data are recorded, analyzes the electrical signals, and solves a set of acoustic equations to extract a representation of the Head Related Transfer Functions therefrom. The processing of the acquired measurements may be performed in a separate computer system.

The system further may include a memory device on which the Head Related Transfer Functions are stored. This memory device may further be used to interface with an audio playback system to synthesize a spatial audio scene to be played to the individual.

The system of the present invention further includes a system for tracking the position of the microphones relative to the sound source. Preferably, the source of a sound is encapsulated into a silicone rubber prior to being inserted into the ear canal.

These and other features and advantages of the present invention will be fully understood and appreciated from the following detailed description of the accompanying Drawings.

DETAILED DESCRIPTION OF THE PREFERRED EMBODIMENT

Figure 2:
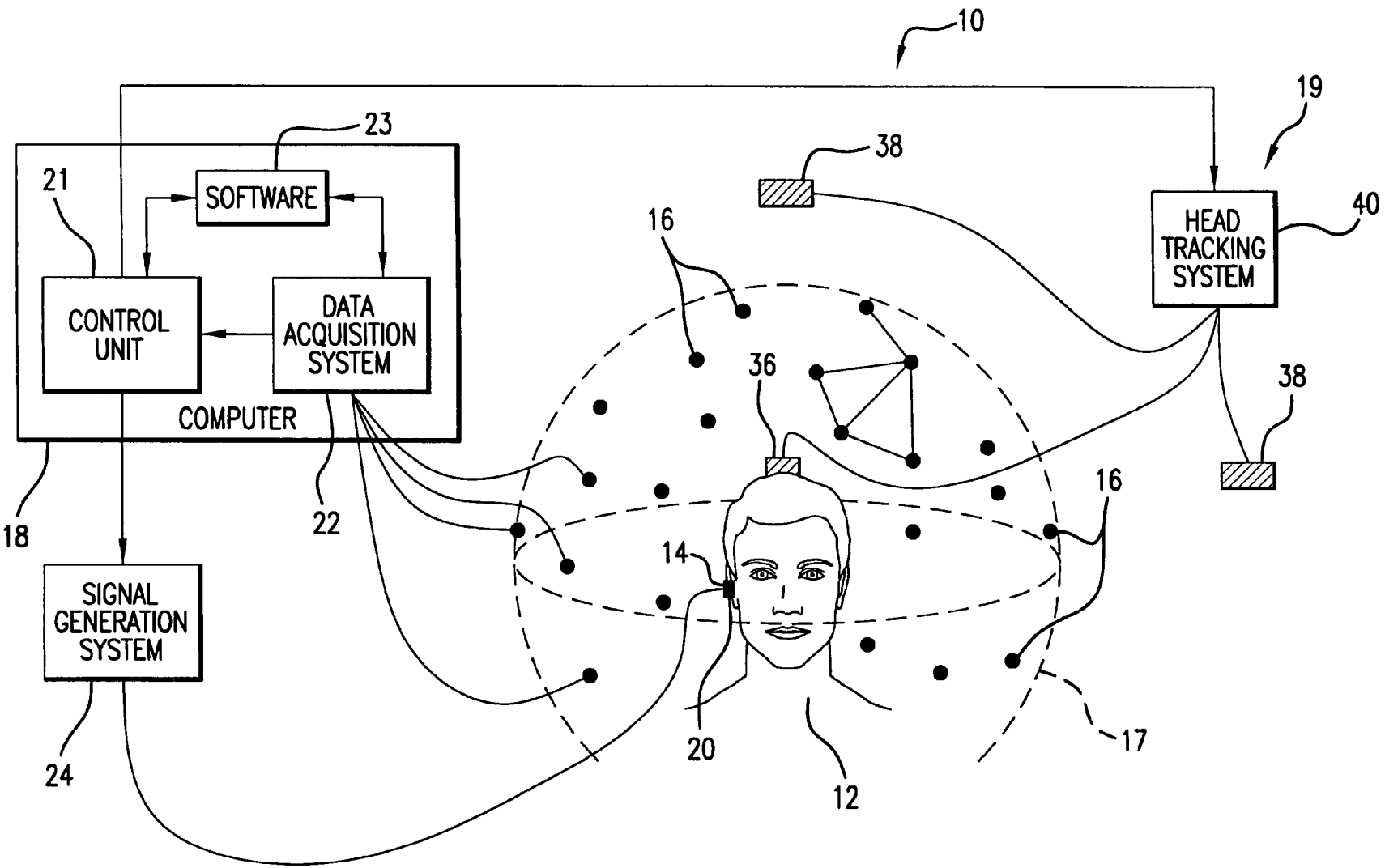
FIG. 2 is a schematic representation of HRTF measurements set up according to the present invention.

With relation to FIG. 2, there is shown a system 10 for measurement of head related transfer function of an individual 12. The system 10 includes a transmitter 14, a plurality of pressure wave sensors (microphones) 16 arranged in a microphone array 17 surrounding the individual's head, a computer 18 for processing data corresponding to the pressure waves reaching the microphones 16 to extract Head Related Transfer Function (HRTF) of the individual, and a head/microphones tracking system 19.

The transmitter 14 (for instance) is a commercially available miniature microspeaker, obtained from Knowles Electronics Holdings Inc. having a business address in Itasca, Ill. This is a miniature microspeaker with a dimension approximately 5 square millimeters in cross-section and 7-8 millimeters in length. The microspeaker is encapsulated in silicone rubber 20, and is placed in one or both ear channels of the individual 12. The silicone rubber blocks the ear canal from environmental noise and also provides for audio comfort for the individual. The measurements are performed first with the microspeaker 14 placed in one ear and then with the microspeaker in the other ear of the individual.

The computer 18 serves to process the acquired data and may include a control unit 21, a data acquisition system 22, and the software 23 running the system of the present invention. Alternatively, the computer 18 may be located in separate fashion from the control unit 21 and data acquisition system 22.

Figure 3:
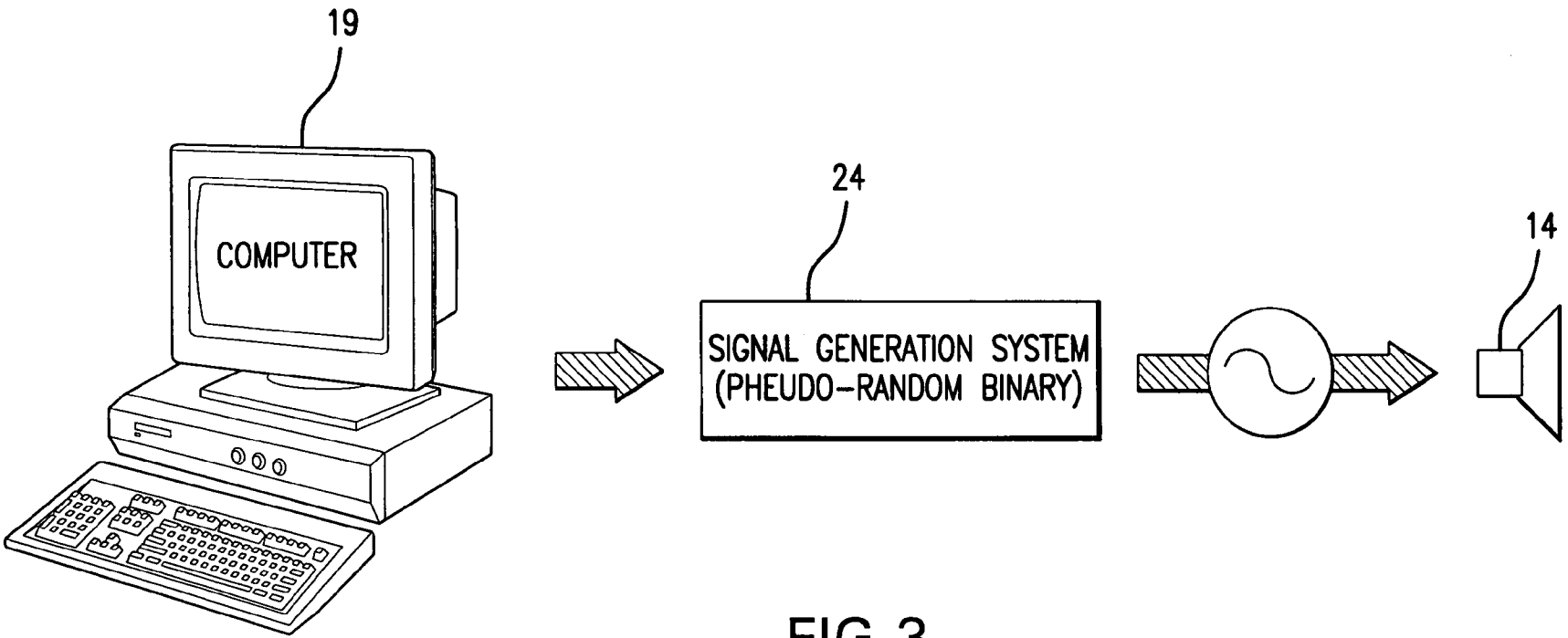
FIG. 3 is a schematic representation of pseudorandom binary signal generation system.

The system 10 further includes a signal generation system 24 shown in FIGS. 2 and 3, which is coupled to the control unit 21 to generate binary signals with specified spectral characteristics (e.g., pseudorandom) supplied to the microspeaker 14 in order that the microspeaker 14 emanates this predetermined combination of audio signals (pseudorandom binary signals) under the command of the control unit 21.

The sound emanating from the microspeaker 14 scatters or reflects from the individual's head and is collected at the microphones 16 in the form of pressure waves which are a function of the sound emanating from the microspeaker, as well as anatomic features of the individual, such as dimension and shape of the head, ears, neck, shoulders, and the texture of the surfaces thereof.

The microphones 16 form the array 17 which envelopes the individual's head. Each microphone 16 has a specific location with regard to the microspeaker 14 described by azimuth, elevation, and distance therefrom. For example, the microphones used in the set-up of the present invention can be acquired from Knowles Electronics, however, other commercially available microphones may be used.

Within the microphones the received pressure wave is converted from the audio format into electrical signals which are recorded in the data acquisition system 22 in the computer 18 for processing. The electric signals received from the microphones 16 are analyzed, and processed by solving a set of acoustic equations (as will be described in detail in further paragraphs) to extract a Head Related Transfer Function of the individual. After the Head Related Transfer Functions are calculated, they are stored in a memory device 25, shown in FIG. 4, which further may be coupled to an interface 26 of an audio playback device such as a headphone 28 used to play a synthetic audio scene. A processing engine 30, which may be either a part of a headphone 28, or an addition thereto, combines the Head Related Transfer Functions read from the memory device 25 through the interface 30 with a sound 32 to create a synthetic audio scene 34 specifically for the individual 12.

The head/microphones tracking system 19 includes a head tracker 36 attached to the individual's head, a microphone array tracker 38 and a head tracking unit 40. The head tracker 36 and the microphone array tracker 38 are coupled to the head tracking system 40 which calculates and tracks relative disposition of the microspeaker 14 and microphones 16.

The measurement of the head related transfer functions are repeated several times at different regions of frequency, as well as different combinations of the pseudorandom binary signals to improve the signal-to-noise ratio of the measurement procedure. The range of frequencies used for the measurements is usually between 1.5 KHz and 16 kHz.

A spherical construction or other enveloping construction may be formed to provide the surround envelope. N microphones 16 are mounted on the sphere, and are connected to custom-built preamplifiers and the recorded signals are captured by multi-channel data acquisition board 22. The sphere (microphone array 17) may be suspended from the ceiling of a room.

To perform measurements, two microspeakers 14 (currently of type Etymotic ED-9689) are wrapped in silicone material 20 that is usually used in ear plugs. These are inserted into the person's left and right ears so that the ear canal is blocked and the microspeakers are flush with the ear canal. Then, the individual 12 is positioned under the sphere 17 and puts his/her head inside the sphere.

The position of the head is centered within the sphere with the aid of head tracker 36 that is attached to the subject's head. The test signal is played through the left ear microspeaker while simultaneously recording signals from sphere-mounted microphones 16, and the same is repeated for the right ear. Measured signals contain left and right ear head-related impulse responses (HRIR) that are normalized and converted to head-related transfer functions (HRTF). In this manner, HRTF set for N points is obtained with one measurement.

The position of a subject may be altered after the first measurement to provide a second set of measurements for different spatial points. The head tracking unit 40 monitors the position of the head (by reading the head tracker 36) and provides exact information about the location of measurement points (by reading the microphone array tracker 38) with respect to initial position. Once the subject is appropriately repositioned, a second measurement is performed in the same manner as described above. The process may be repeated to sample HRTF as densely as is desired.

In the arrangement of the present invention, when the transmitter 14 is placed in the ear (ears) and the receivers (microphones) 16 surround the head of the individual 12, the multipath sound from the microspeaker is received at the microphones, and each of the sound pressure received at a particular microphone may be represented as $$\psi = \sum_{l=0}^{p-1} + \sum_{l=p}^{\infty}\left(\sum_{m=-l}^{l} \alpha_{lm} h_l(kr) Y_{lm}(\theta, \varphi)\right). \tag{6}$$

In practice the outer summation after p terms is truncated and terms from p to ∞ are ignored. The $\alpha_{lm}$ can then be fit using the regularized fitting approach discussed in detail infra.

In the computer 18, data acquisition system 22 and the control unit 21, an analysis of the obtained data is performed to express the Head Related Transfer Function in terms of a series of multipole solutions of the Helmholtz equation. In this analysis, HRTF experimental data may be fit as a series of multipoles of the Helmholtz equations from the basis of regularized fitting approach as will be described infra with regard to FIGS. 4-6. This approach also leads to a natural solution to the problem of HRTF interpolation, since the fit series provides the intermediate HRTF values corresponding to the points between microphones as well as in the range closer to or further from the microspeaker than the microphones' positions. The software 23 in the computer 18 calculates the range dependence of the HRTF in the near field by extrapolation from HRTF measurement at one range.

Figure 4:
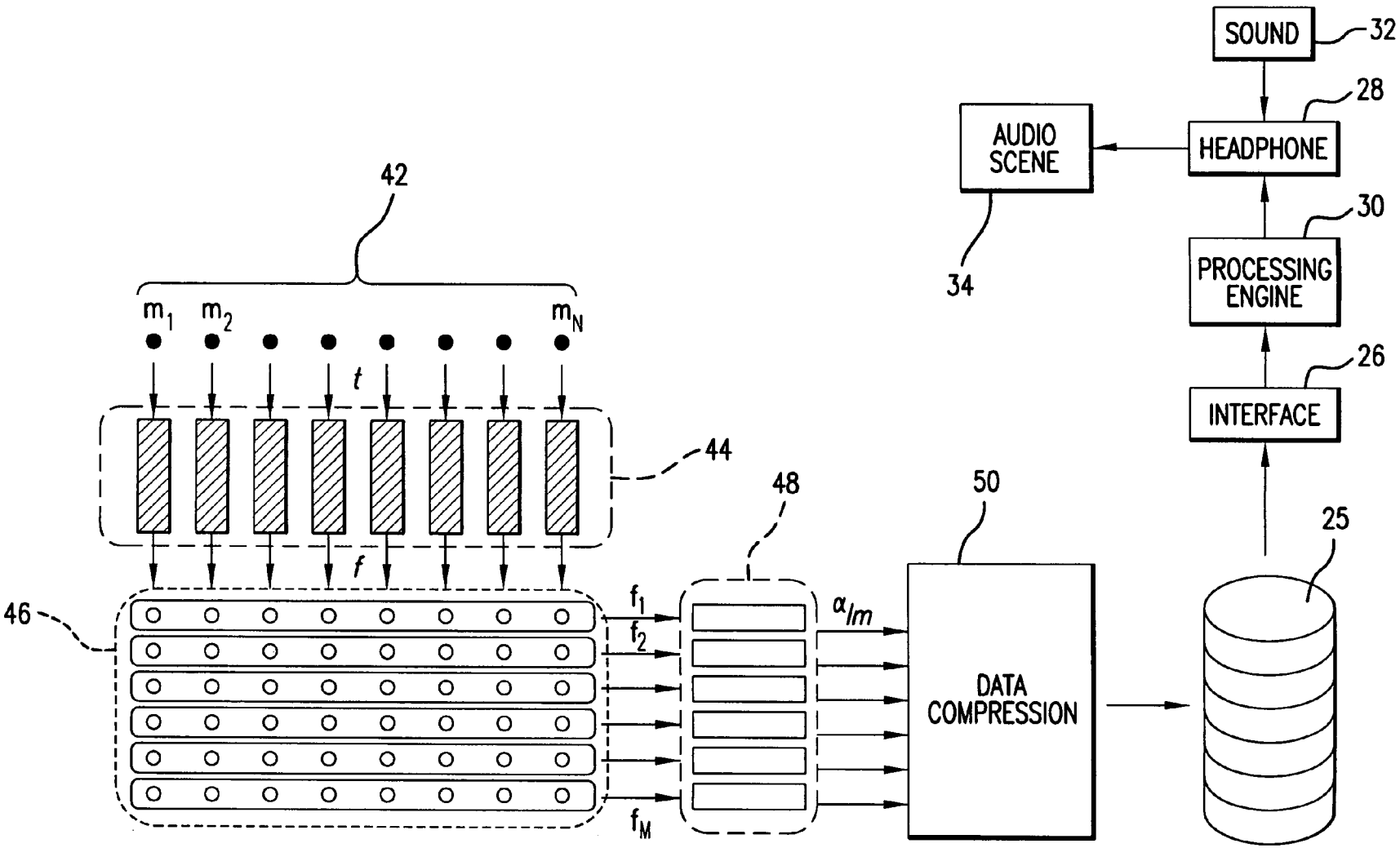
FIG. 4 is a schematic representation of the computation of the Head Related Transfer Functions.

FIG. 4 schematically shows a computation procedure of the HRTF where the time domain signal (in electrical form) acquired by the microphone array 17 are transformed by the Fast Fourier Transform 44 into signals in frequency domain 46. The frequency signals $f_1 \ldots f_m$ are input to the block 48 where the fitting procedure is performed, based on a transforming of the signals in frequency domain to the spherical functions coefficients domain. From the block 48, the spherical functions coefficients $\alpha_{lm}$ are supplied to the block 50 for data compression (this procedure is optional) and further the compressed HRTFs are stored on the memory device 25 for further use for synthesis of a spatial audio scene.

Figure 5:
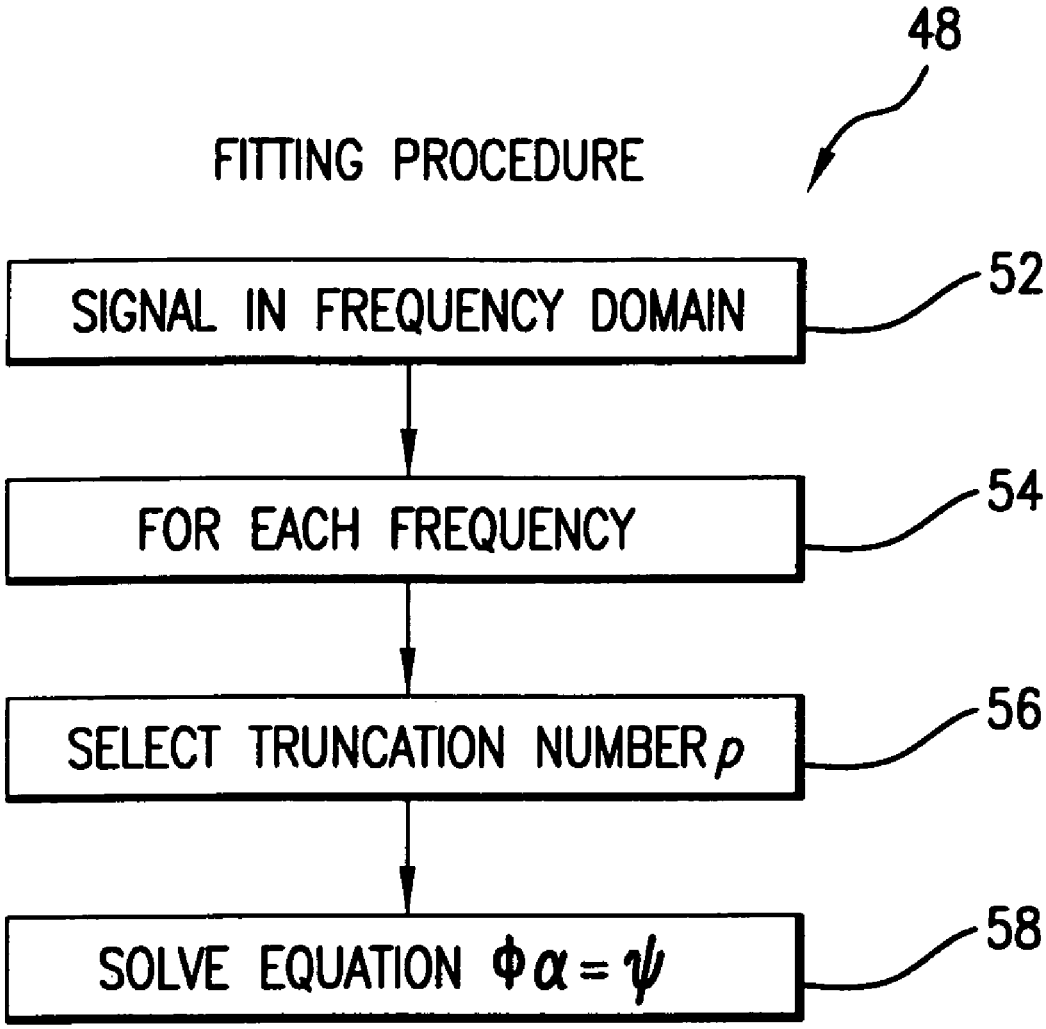
FIG. 5 is a block diagram representing the fitting procedure of the present invention; and, FIG. 6 is a flow chart diagram of the HRTF fitting procedure of the present invention.

The fitting procedure performed in block 48 of FIG. 4, is shown more in detail in FIG. 5, wherein once the time domain electrical signals have been transformed to the frequency domain in the block 52, for each frequency (from $f_1$ through $f_m$) selected in block 54, the fitting procedure chooses the truncation number p in block 56. Further, for the selected truncation number p, the fitting procedure further solves the equation $\Phi\alpha=\Psi$ in block 58, wherein $\alpha$ is a set of expansion coefficients over the spherical function basis, $\Psi$ is a set of signal amplitudes at acquisition microphone locations, and $\Phi$ is the matrix of multipoles evaluated at the microphone locations.

For practical computations, the sum over l is truncated at some point called the truncation number p, leaving a total of $M=p^2$ terms in multipole expansion. In addition, the values of potential $\Psi_h(x,k)$ are known at N measurement points at the reference sphere, $\{x_1 \ldots x_N\}$. N linear equations for M unknowns $\alpha_{lm}$ may be written as:

$$\psi_h(x_1, k) = \sum_{l=0}^{p-1} \sum_{m=-l}^{l} \alpha_{lm} \Phi_{lm}(x_N, k), \tag{7}$$

-continued $$\psi_h(x_N, k) = \sum_{l=0}^{p-1} \sum_{m=-l}^{l} \alpha_{lm} \Phi_{lm}(x_N, k),$$

or, in short form, $\Phi\alpha=\Psi$, (which is solved in the block 58 of FIG. 5) where the $\Phi$ is N×M matrix of the values of multipoles at measurement points, $\alpha$ is an unknown vector of coefficients of length M, and $\Psi$ is a vector of potential values of length N. This system is usually determined (N>M), and solved in the least squares sense.

Figure 6:
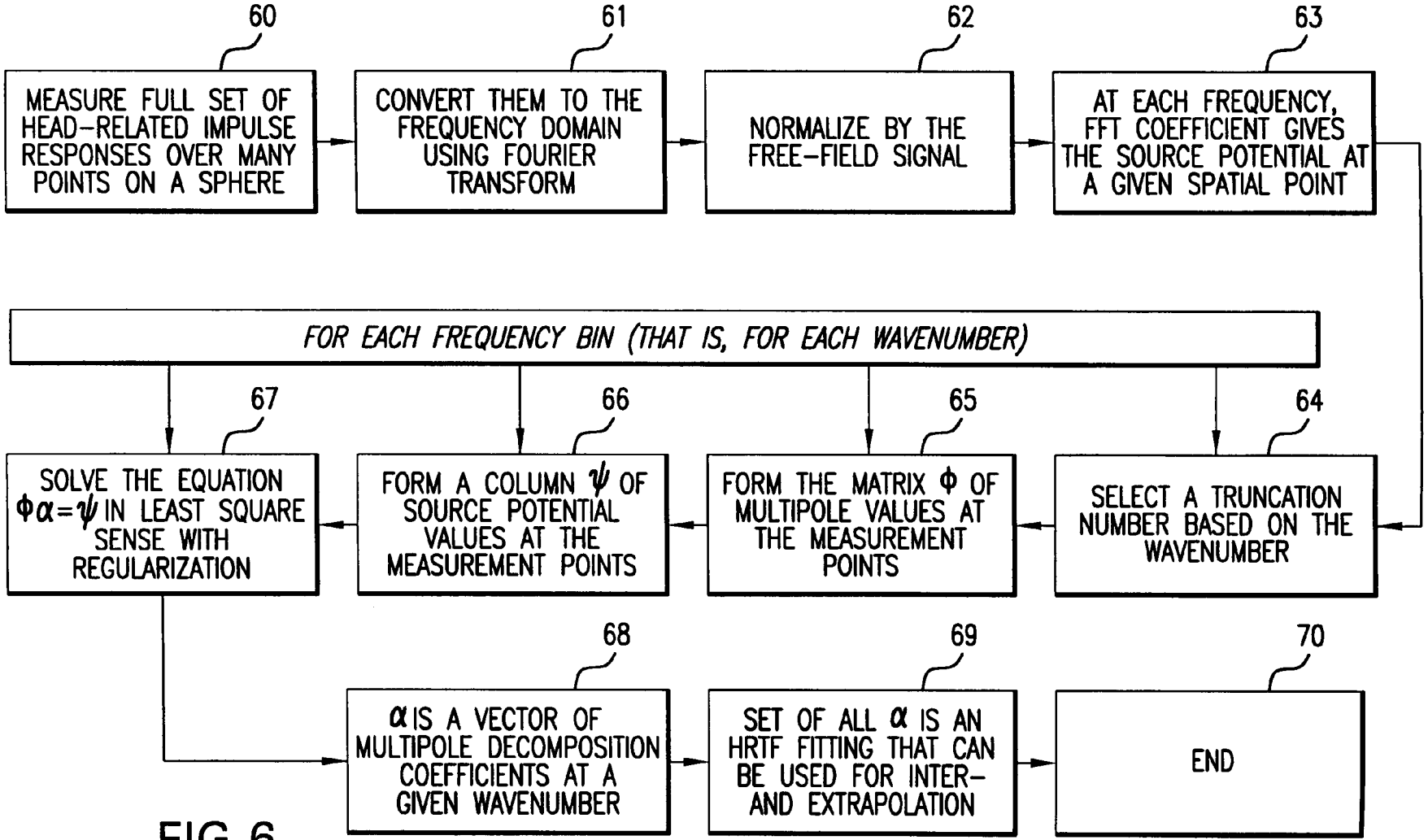

More in detail, the HRTF fitting procedure is presented in FIG. 6 which illustrates the flow chart diagram of the software associated with the HRTF fitting of the present invention. As shown in FIG. 6, the flow chart starts in the block 60 "Measure Full Set of Head Related Impulse Responses Over Many Points on a Sphere", where the pressure waves generated by the sound emanated from the microspeaker 14 are detected in each of the microphones 16 of the microphone array 17.

The signals reaching the microphones 16 are converted thereat to electrical format. From the block 60, the HRTF fitting procedure flows to the block 61, where the time domain electrical signals acquired by the microphones of the microphone array 17 are converted to the frequency domain using Fourier transforms.

Further, the logic moves to the block 62 "Normalize by the Free Field Signal". From the block 62, the flow chart moves to the block 63 wherein at each frequency from $f_1$ to $f_m$, the Fast Fourier Transform coefficient gives the first potential (pressure wave reaching the microphone) at a given spatial point.

Subsequent to block 63, the logic flows to the block 64, where a truncation number p is selected based on the wavenumber of the signal (e.g., for each frequency bin). The flow logic then moves to the block 65 where the matrix $\Phi$ is formed of multipole values at the measurement point (locations of the microphone).

Upon completion of the procedure in the block 65, the logic flow then goes to block 66, where a column $\Psi$ is formed of source potential values at the measurement point. Upon forming the matrix $\Phi$ in block 65 and a column $\Psi$ is block 66, the logic flows to the block 67 where the equation $\Phi\alpha=\Psi$ is solved in least square sense with regularization. The set of expansion coefficients over the spherical function basis (vectors of multipole decomposition coefficients at given wavenumber) $\alpha$ is obtained, in order that the set of all $\alpha$ can be used as the HRTF fitting for interpolation and extrapolation. In the block 70, the HRTF fitting flow chart ends.

Once the equation (7) is solved in block 58 of FIG. 5 or block 67 of FIG. 6, and the set of coefficients $\alpha$ is determined, the acoustic field may be evaluated at any desired point outside the sphere (block 69 of FIG. 6). This means that the acoustic field can be evaluated at the points with a different range.

Obviously, a certain level of spatial resolution is necessary to capture the potential field. The spatial resolution is related to the wavelength by the Nyquist criteria as known from J. D. Maynard, E. G. Williams, Y. Lee (1985) "Nearfield acoustic holography: Theory of generalized holography and the development of NAH", J. Acoust. Soc. Am. 78, pp. 1395-1413. It can be shown that the number of the measurement points necessary to obtain accurate holographic reading for up to the limit of human hearing is about 2000, which is almost twice as large as the number of HRTF measurement points in any currently existing HRTF measurement system. The radius of the sphere 24 used in these measurements is of no great importance due to reciprocity analysis.

Choice of Truncation Number: The primary parameter that affects the quality of the fitting is the truncation number p in Eq. (6). A higher truncation number results in better quality of fitting for a fixed r, but too large a p leads to overfitting. The general rule of thumb is that the truncation number should be roughly equal to the wavenumber for good interpolation quality (N. A. Gumerov and R. Duraiswami (2002) "Computation of scattering from N spheres using multipole reexpansion", J. Acoust. Soc. Am., 112, pp. 2688-2701). This rule is also used in the fast multipole method. If the wavenumber is small, the potential field cannot vary rapidly and high-degree multipoles are unnecessary for a good fit. However, high-degree multipoles may have disadvantageous effects when the potential field approximated at $r_h$ is evaluated at $r<r_h$ due to exponential growth of the spherical Bessel functions of the first kind $j_l(kr)$ as the argument kr approaches zero. Thus, p is set, e.g., as follows:

$$p=\text{integer}(kr)+1. \tag{8}$$

When doing resynthesis, this can lead to artifacts when two adjoint frequency bins are processed with different truncation numbers and a solution must be developed for this.

Regularization: Use of regularization helps avoid blow-up of the approximated function in areas where no data is available (usually at low elevations) and thus the function is not constrained. Many regularization techniques may be employed. Herein the process of Tikhonov regularization is described. With Tikhonov fitting the equation becomes $$(\Phi^T\Phi+\epsilon D)\alpha=\Phi^T\Psi \tag{9}$$

Here $\epsilon$ is the regularization coefficient, D is the diagonal damping or regularization matrix. In further computations D is set to:

$$D=(1+l(l+1))I \tag{10}$$

where l is the degree of the corresponding multipole coefficient and I is the identity matrix. In this manner, high-degree harmonics are penalized more than low-degree ones which is seen to improve interpolation quality and avoid excessive "jagging" of the approximation. Even small values of $\epsilon$ prevent approximation blowup in unconstrained area. Thus, $\epsilon$ is set to some value, such as for example $\epsilon=10^{-6}$ for the system. Those skilled in the art may also employ other techniques for the choice of $\epsilon$, (e.g., as described by Dianne P. O'Leary, Near-Optimal Parameters for Tikhonov and Other Regularization Methods", SLAM J. on Scientific Computing, Vol. 23, 1161-1171, (2001)). Once the coefficients $\alpha$ are obtained the field $\Psi$ may be evaluated at any point and the Head Related Transfer Function there obtained. This procedure allows for both angular interpolation of the HRTF and its extrapolation to a range other than the location of the measurement microphones.

In the present invention, a miniature loudspeaker is placed in the ear, and a microphone is located at a desired spatial position. Moreover, a plurality of microphones may be placed around the person, enabling one-shot HRTF measurement by recording signals from these microphones simultaneously while the loudspeaker in the ear plays the test signal (white noise, frequency sweep, Golay codes, etc.).

Figure 1:
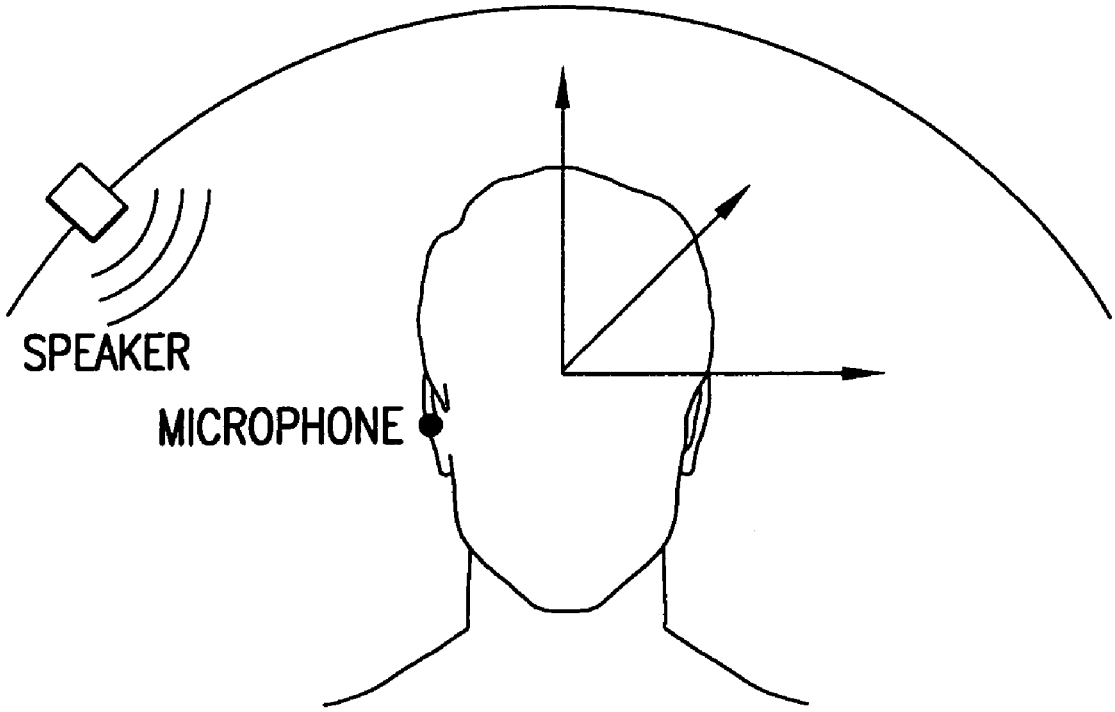
PRIOR ART FIG. 1
FIG. 1 is a schematic arrangement of HRTF measurements set up according to the prior art.

One potential problem with this approach is inability to measure low-frequency HRTF reliably due to the small size of the transmitter. However, it is known that low-frequency HRTF measurements are not very reliable even with existing measurement methods. To alleviate the current problems, an optimal analytical model of low-frequency HRTF was used to compute low-frequency HRTF in the setup shown in FIG. 1. This low frequency model is described in V. R. Algazi, R. O. Duda, and D. M. Thompson (2002). "The use of head-and-torso models for improved spatial sound synthesis", Proc. AES 113$^{th}$ Convention, Los Angeles, Calif., preprint 5712, and is used to specify Head Related Transfer Functions to 1-5 kHz to obtain Head Related Transfer Functions above 1.5 kHz.

Evaluation of the method used has been performed in which a spherical construction was fabricated to support the microphones. Thirty-two microphones were mounted on the sphere. The microphones were connected to custom-built preamplifiers and the recorded signals were captured by multichannel data acquisition board. The sphere was suspended from the ceiling of a laboratory room. In a preferred embodiment the number of microphones will be large and determined by the spherical holography analysis (J. D. Maynard, E. G. Williams, Y. Lee (1985) "Nearfield acoustic holography: Theory of generalized holography and the development of NAH", J. Acoust. Soc. Am. 78, pp. 1395-1413).

To perform the measurement, two microspeakers (Etymotic ED-9689) were wrapped in the silicone material that is usually used for the ear plugs and were inserted into the person's left and right ears so that the ear canal was blocked. The person stood inside of the sphere and centered him/herself by looking at the microphone directly at front of him. The test signal was played through the left ear microspeaker and signals from all 32 microphones were recorded, and the same was repeated for the right ear. This way, the HRTF measurements were completed for 32 points. The system has been expanded to accommodate 32 more microphones. A person's position may be altered to provide 32 more measurements for different spatial points.

Although this invention has been described in connection with specific forms and embodiments thereof, it will be appreciated that various modifications other than those discussed above may be resorted to without departing from the spirit or scope of the invention as defined in the appended Claims. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A method for measurement of Head Related Transfer Functions, comprising the steps of:

placing a sound source into an individual's ear;

establishing a microphone array of a plurality of microphones, said microphone array enveloping the individual's head, emanating a predetermined combination of audio signals from said sound source, said combination of audio signals propagating in an outward direction from said individual's ear;

collecting pressure wave signals at said microphones generated by said audio signals, said pressure wave signals being a function of anatomical properties of the individual, and processing data corresponding to said pressure wave signals to extract a Head Related Transfer Function (HRTF), based on said signals which emanate from within said ear of the individual, and propagate in an outward direction therefrom.

2. The method of claim 1, further comprising the steps of:

converting said pressure wave signals into time domain electrical signals and recording the same in a processing system for processing therein.

3. The method of claim 1, further comprising the steps of:
generating said predetermined combination of said audio signals, and coupling said audio signals to said source of the sound.

4. The method of claim 2, wherein said processing of said time domain electrical signals comprises the steps of:
transforming said time domain electrical signals acquired by said microphone array to the frequency domain, and
applying a HRTF fitting procedure to said frequency domain signals by transforming the same to spherical functions coefficients domain, representing HRTFs.

5. The method of claim 4, further comprising the step of:
compressing said spherical functions coefficients.

6. The method of claim 4, further comprising the step of:
storing said HRTFs on a memory device.

7. The method of claim 6, further comprising the steps of:
interfacing said memory device with an audio playback device,
combining sounds to emanate from said audio playback device with said Head Related Transfer Functions of the individual thereby synthesizing a spatial audio scene, and
playing said combined sounds to the individual.

8. The method of claim 1, further comprising the step of:
encapsulating said source of a sound into a silicone rubber.

9. The method of claim 1, wherein said first audio signals are low frequency audio signals in the range of frequency approximately from 1.5 kHz to the upper limit of hearing.

10. The method of claim 1, further comprising the steps of:
tracking the position of said plurality of the microphones relative to said sound source.

11. A method for measurement of Head Related Transfer Functions, comprising the steps of:
placing a sound source into an individual's ear;
establishing a microphone array of a plurality of microphones, said microphone array enveloping the individual's head,
emanating a predetermined combination of audio signals from said sound source,
collecting pressure wave signals at said microphones generated by said audio signals, said pressure wave signals being a function of anatomical properties of the individual;
processing data corresponding to said pressure wave signals to extract a Head Related Transfer Function (HRTF) of the individual therefrom;
converting said pressure wave signals into time domain electrical signals and recording the same in a processing system for processing therein;
transforming said time domain electrical signals acquired by said microphone array to the frequency domain;
applying a HRTF fitting procedure to said frequency domain signals by transforming the same to spherical functions coefficients domain, representing HRTFs;
selecting a truncation number p for each wavenumber in said frequency domain,
forming a matrix $\{\phi\}$ of multipoles evaluated at locations of said microphones,
forming a set $\{\psi\}$ of signal amplitudes at said locations of said microphones, and solving an equation $$\Phi\alpha = \Psi$$

to obtain a set $\{\alpha\}$ of multipole decomposition coefficients over the spherical function basis.

12. The method of claim 11, further comprising the steps of interpolating and extrapolating the HRTF to any valid point located at the space around the individual's head using said coefficients.

13. A system for measurement of Head Related Transfer Function, comprising:
a sound source adapted to be positioned in the ear of an individual,
means for generating a predetermined combination of audio signals emanating from said sound source,
a plurality of pressure wave sensors positioned in enveloping relationship with the head of the individual,
said pressure wave sensors collecting pressure waves generated by said audio signals emanating from said sound source,
data processing means for processing data corresponding to said pressure waves to extract the Head Related Transfer Functions therefrom, wherein the step of extracting further includes:
selecting a truncation number p for each wavenumber in a frequency domain derived from a time domain, said time domain in turn derived from signals converted from and corresponding to said pressure waves,
forming a matrix $\{\Phi\}$ of multipoles evaluated at locations of said pressure wave sensors,
forming a set $\{\psi\}$ of signal amplitudes at said locations of said pressure wave sensors, and solving an equation $$\Phi\alpha = \Psi$$

to obtain a set $\{\alpha\}$ of multipole decomposition coefficients over a spherical function basis;
means for interpolating and extrapolating said Head Related Transfer Functions to any valid point located at the space around an individual's head using said coefficients,
means for converting said collected pressure waves into electric signals corresponding thereto,
signals acquisition system coupled to said pressure wave sensors,
means for recording said electric signals in said data processing means for processing therein,
a control system coupled to said data signals acquisition system to receive data therefrom,
a signal generation system coupled at the output thereof to said sound source and at the input thereof to said control system,
a head tracker attached to the head of the individual,
a head tracking system coupled to said head tracker and said control system, said head tracker system monitors the position of the head and provides exact information about a location of measurement points with respect to initial position, and
sensors tracker coupled to said head tracking system.

14. The system of claim 13, wherein said processing means further comprises:
means for applying a HRTF fitting procedure to data corresponding to acquired pressure waves at said sensors to obtain HRTFs therefrom, and
a memory device for storing these obtained HRTFs.

* * * * *